US005228246A

United States Patent [19]

Suzuki et al.

[11] Patent Number: 5,228,246

[45] Date of Patent: Jul. 20, 1993

[54] APPARATUS FOR TURNING UP AN DOWN SEATS FOR TELESCOPIC SEATING SYSTEM

[75] Inventors: Fumihiko Suzuki; Toshihiko Kimura, both of Tokyo, Japan

[73] Assignee: Kabushiki Kaisha Kotobuki, Tokyo, Japan

[21] Appl. No.: 687,392

[22] Filed: Apr. 18, 1991

[30] Foreign Application Priority Data

Apr. 18, 1990 [JP] Japan ..... 2-102551

[51] Int. Cl.[5] ..... E04H 3/12

[52] U.S. Cl. ..... 52/9

[58] Field of Search ..... 52/8, 9, 10, 6; 297/331, 332, 333, 334, 335, 336, 325, 232, 236, 250, 35

[56] References Cited

U.S. PATENT DOCUMENTS 4,063,392 12/1977 Van Ryn et al. ..... 52/9
4,155,202 3/1979 Hartman .
4,446,659 5/1984 Quigley ..... 52/9
4,557,080 12/1985 Walworth et al. ..... 52/9
4,569,162 2/1986 Suzuki .
4,702,043 10/1987 Suzuki .

FOREIGN PATENT DOCUMENTS 369094 5/1990 European Pat. Off. ..... 52/8

*Primary Examiner*—Michael Safavi

*Attorney, Agent, or Firm*—Oldham, Olham & Wilson Co., L.P.A.

[57] ABSTRACT

An apparatus for turning up and down seats for a telescopic seating system includes as essential components a foot on which a single seat is fixedly mounted, a base frame having a support shaft inserted therethrough in the transverse direction so as to allow the foot to be turned up and down about the support shaft, a center shaft extending through the base frame in parallel with the support shaft and including an extension outside of the housing, a guide arm turnably mounted on the extension of the center shaft, a pair of first coil springs mounted on the support shaft within the interior of the base frame so as to allow the foot to be normally biased in the turning-up direction, a second coil spring mounted on the extension of the center shaft so as to allow the guide arm to be normally turnably biased in the forward direction, and a pair of tongue-shaped projections fixedly mounted on the center shaft within the interior of the base frame, a link plate bridged between a front shaft on the foot and a rear shaft on the tongue-shaped projections. When the telescopic seating system is in use, turning movement of the guide arm induced by forward movement of a movable platform at the lower stage is transmitted to the foot via the center shaft, the tongue-shaped projections and the link plate, whereby the foot is turned up to assume the upright standing attitude.

6 Claims, 5 Drawing Sheets

APPARATUS FOR TURNING UP AN DOWN SEATS FOR TELESCOPIC SEATING SYSTEM

BACKGROUND OF THE INVENTION

Field of the Invention

The present invention relates generally to an apparatus for turning up and down a number of seats for a telescopic seating system. More particularly, the present invention relates to an apparatus for turning up spectators' seats to assume the upright standing attitude before using the telescopic seating system and turning down them to assume the horizontally laid attitude after completion of the practical use of the same.

Description of the Related Art

In recent years, a telescopic seating system including a plurality of extensive/contractive movable platforms arranged in tiers is increasingly employed for a building such as a gymnasium or the like facility in order to utilize the floor space more effectively by fully accommodating all the movable platforms in a cavity formed in the one side wall structure of the building when the telescopic seating system is not in use. The movable platforms used for the telescopic seating system are arranged in the form of a so-called doll tier stand such that the foremost movable platform is located at the lowermost position and the rearmost movable platform is located at the highest position when the telescopic seating system is practically used while all the movable platforms assume their extended attitude. They are successively operatively connected to each other and they assume the extended attitude in the doll tier stand-shaped configuration by starting forward movement with the lowermost movable platform. On completion of the forward movement of all the movable platforms, all spectators seats stand upright so that spectators can sit on the seats which are allocated to them. On the other hand, when the practical use of the telescopic seating system is over, all the movable platforms are successively accommodated in the cavity of the building without any projection from the wall surface by starting rearward movement with the lowermost movable platform.

However, it has been found that the conventional telescopic seating system has the following problems.

Specifically, when the telescopic seating system is in use, all the movable platforms are extended in the doll tier stand-shaped configuration and all the seats arranged side by side in the transverse direction on each movable platform are simultaneously raised up. After completion of the practical use of the telescopic seating system, all the seats are turned down and then all the movable platforms are then successively accommodated in the cavity of the building. Hitherto, the seats on each movable platform are turned up and down with the aid of a large magnitude of power derived from an electric motor or a hydraulic motor. However, to generate such a high intensity of power as mentioned above, a large scale of facility should unavoidably be installed and a large quantity of electricity is consumed for operating the facility with the result that the telescopic seating system is practically used at an expensive cost with a degraded economical efficiency, e.g., in respect of effective utilization of the gymnasium designed and constructed for various kinds of purposes. Especially, a raising-up operation has been heretofore performed such that the horizontally laid seats are turned up by lifting them at the top ends thereof with the aid of an electric motor or the like means. This leads to the result that the telescopic seating system has a degraded appearance.

In view of the aforementioned problems, a proposal has been made such that a plurality of springs are used for raising up each seat. According to this proposal, it is required that all the springs are simultaneously actuated when the seat is turned down. To this end, however, a large magnitude of force should be exerted on the respective springs. In addition, an unpleasant noisy sound such as a creaking sound or the like is generated from the seat when all the springs are simultaneously quickly compressed. A most significant problem in a case where the telescopic seating system is constructed on a large scale and includes many movable platforms which are arranged in tiers, it is practically difficult for the telescopic seating system to fully accommodated all the movable platforms in the cavity of the building without any projection from the wall surface of the building because of a necessity for a large magnitude of power to be derived from electric motors or the like means.

SUMMARY OF THE INVENTION

The present invention has been made with the foregoing background in mind.

An object of the present invention is to provide an apparatus for turning up and down a number of seats for a telescopic seating system which is entirely free from the problems inherent to the conventional telescopic seating system.

Other object of the present invention is to provide an apparatus for turning up and down a number of seats for a telescopic seating system wherein each seat on each movable platform is easily turned up with the aid of a sum of the resilient forces derived from a plurality of coil springs without necessity for an extra power to be generated by an electric motor or the like means.

Another object of the present invention is to provide an apparatus for turning up and down a number of seats for a telescopic seating system wherein all the seats arranged on each movable platform side by side in the transverse direction can simultaneously smoothly be turned down by utilizing successive rearward movement of the movable platforms when the telescopic seating system is not put in practical use.

To accomplish the above objects, the present invention provides an apparatus for turning up and down seats for a telescopic seating system including a plurality of movable platforms to be arranged in tiers when the telescopic seating system is in use, the movable platforms being successively operatively connected to each other to extend and contract in the forward/rearward direction, the respective seats being arranged side by side in the transverse direction on each movable platform, wherein the apparatus includes as essential components a foot on which a single seat is fixedly mounted, the foot being turned up and down about a support shaft, a housing in the form of a base frame having a substantially U-shaped cross-sectional configuration, the housing having the support shaft for the foot immovably inserted therethrough in the transverse direction at the fore end part thereof, a center shaft rotatably inserted through the housing in the transverse direction at the central part of the housing, the center shaft extending in parallel with the support shaft and including an extension outside of the outer side wall of the housing, a guide arm turnably mounted on the extension of the center shaft, the lowermost end part of the guide arm being placed on the upper surface of a rear transverse beam for a movable platform at the lower stage when the telescopic seating system is not in use and colliding against the rear surface of the transverse beam when the telescopic seating system is in use, a pair of first coil springs mounted on the support shaft on both sides of the foot within the interior of the housing, one end of each of the first coil springs being fixedly secured to the foot and the other end of the same being fixedly secured to the support shaft so as to allow the foot to be normally biased in the turning-up direction by the resilient force derived from the first coil springs, a second coil spring mounted on the extension of the center shaft outside of the outer side wall of the housing between the housing and the guide arm, one end of the second coil spring being fixedly secured to the center shaft and the other end of the same being fixedly secured to the guide arm so as to allow the guide arm to be normally turnably biased in the forward direction by the resilient force derived from the second coil spring, a pair of tongue-shaped projections fixedly mounted on the center shaft within the interior of the housing while rearwardly extending from the center shaft in the slantwise downward direction, the tongue-shaped projections having a rear shaft inserted therethrough in the transverse direction at the outer ends thereof, and a link plate bridged between a front shaft inserted through the foot in the transverse direction and the rear shaft on the tongue-shaped projections so as to establish an operative connection between the foot and the guide arm via the tongue-shaped projections and the center shaft, the link plate curvedly extending behind the center shaft from the front shaft on the foot down to the rear shaft on the tongue-shaped projections, whereby in response to forward slidable movement of the movable platform on the lower side, the guide arm is turned in the forward direction by the resilient force derived from the second coil spring and thereby the foot is turnably raised up with the aid of the resilient force derived from the first coil springs to assume the upright standing attitude, via the center shaft, the tongue-shaped projections and the link plate.

On completion of the practical use of the telescopic seating system, the movable platform at the lower stage is displaced in the rearward direction and thereby the guide arm which has been brought in contact with the rear surface of the front transverse beam at the present stage collides against the rear transverse beam of the movable platform at the lower stage, whereby the rearward turning movement of the guide arm is transmitted to the foot which has stood upright, via the center shaft, the tongue-shaped projections and the link plate so as to allow the foot to be turned down.

As the movable platform at the present stage is displaced in the rearward direction, the rear surface of the foot collides against the front nose of a movable platform at the upper stage, whereby the foot is fully turned down against the resilient force of the first coil springs to assume the horizontally laid attitude.

To assure that the apparatus functions more reliably, it is recommendable that the apparatus further includes a rotary member which is fixedly mounted on the extension of the center shaft outside of the guide arm such that an opposing pair of stoppers are protruded toward the guide arm in the axial direction of the center shaft. One of the stoppers located in front of the center shaft is to be brought in contact with the front surface of the guide arm so as to limit the forward turning movement of the guide arm, while the other stopper located behind the center shaft is to be brought in contact with the rear surface of the guide arm so as to allow the rearward turning movement of the guide arm to be transmitted to the foot via this stopper, the rotary member, the center shaft, the tongue-shaped projections and the link plate.

Additionally, it is recommendable that the apparatus further includes a third coil spring which is mounted on the extension of the center shaft between the guide arm and the rotary member. One end of the third coil spring is fixedly secured to the guide arm, while the other end of the same is fixedly secured to the rotary member so as to allow the guide arm to be normally turnably biased in the forward direction in addition to the second coil spring.

As the foot is turnably raised up, the guide arm collides against the front transverse beam of the movable platform at the present stage at an intermediate position which is located slightly before the upright standing position. Thereafter, the foot continues to be turnably raised up until the upright standing position is reached, merely with the aid of the resilient force derived from the first coil springs.

Other object, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENT

Now, the present invention will be described in detail hereinafter with reference to the accompanying drawings which illustrate a preferred embodiment of the present invention.

Figure 7:
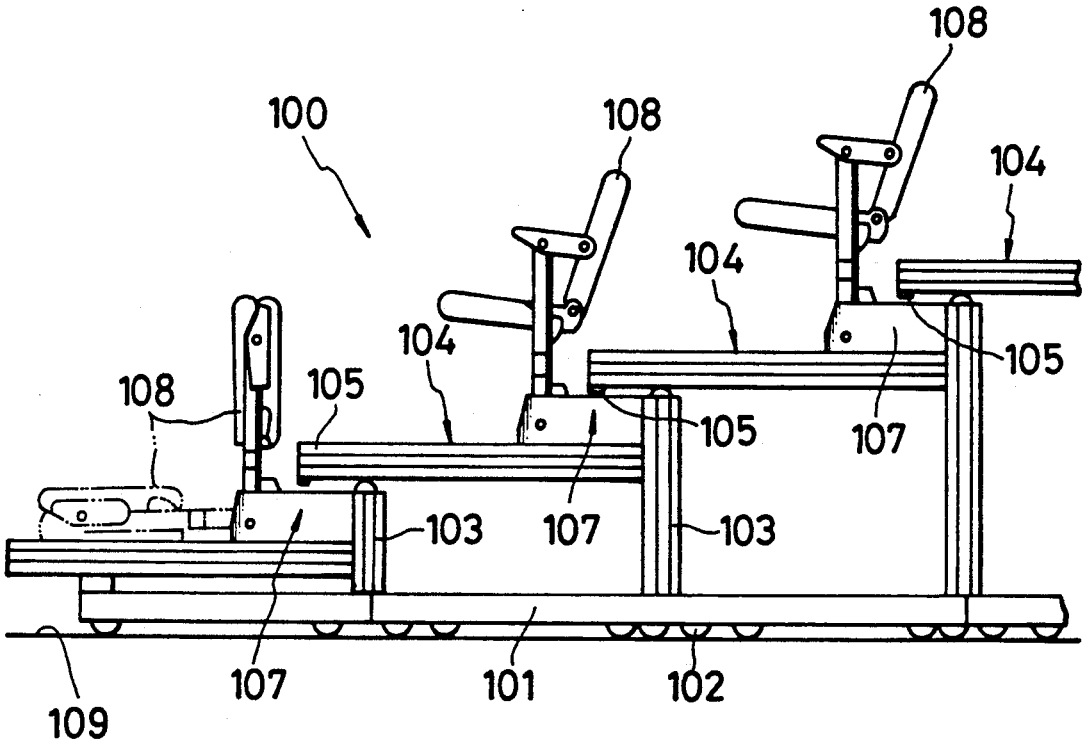
FIG. 7 is a partially sectioned side view of the telescopic seating system for which a number of apparatuses of the present invention are employed.

First, description will be made below as to a telescopic seating system generally designated by reference numeral 100 for which an apparatus for turning up and down a number of seats (hereinafter referred to simply as an apparatus) according to the present invention is employed. FIG. 7 is a fragmentary side view of the telescopic seating system 100. When the telescopic seating system 100 is practically used, the whole telescopic seating system 100 is forwardly displaced along a floor surface 109. Specifically, a plurality of movable platforms 104 having a number of spectators seats 108 mounted side by side in the transverse direction thereon are successively drawn from the lower stage side in the forward direction together with base boards 101 and support columns 103 fixedly secured to the movable platforms 104 with the aid of a number of rollers 102 which are driven by an actuating mechanism (not shown). On completion of the slidable movement of the movable platform 104 in the forward direction, the telescopic seating system exhibits the fully extended state and all the platforms 104 are arranged in tiers, as shown in FIG. 7. After a certain performance is over and the telescopic seating system is to be brought in the inoperative state, all the base board 101 having the platforms 104 mounted thereon are successively retracted from the lower stage side, until all the movable platforms 104 are fully accommodated in the cavity of a building (not shown) by way of the reverse steps to those as mentioned above without any projection from the side wall surface of the building.

Each movable platform 104 to be arranged in tiers in the operative state includes a plurality of seats 108 in the side-by-side relationship each of which is allocated to one of plural blocks equally spaced along the transversely extending movable platform 104.

Next, the apparatus in accordance with the embodiment of the present invention designated by reference numeral 107 in FIG. 7 will be described below with reference to FIG. 1 to FIG. 6. In practice, two apparatuses 107 are arranged on the both sides of each spectator's seat 108. However, description will be made below as to one of the two apparatuses 17 for the purpose of simplification of description, because all components constituting each of the left-hand and right-hand apparatuses are same to each other with the exception that they are arranged in the symmetrically relationship.

Figure 1:
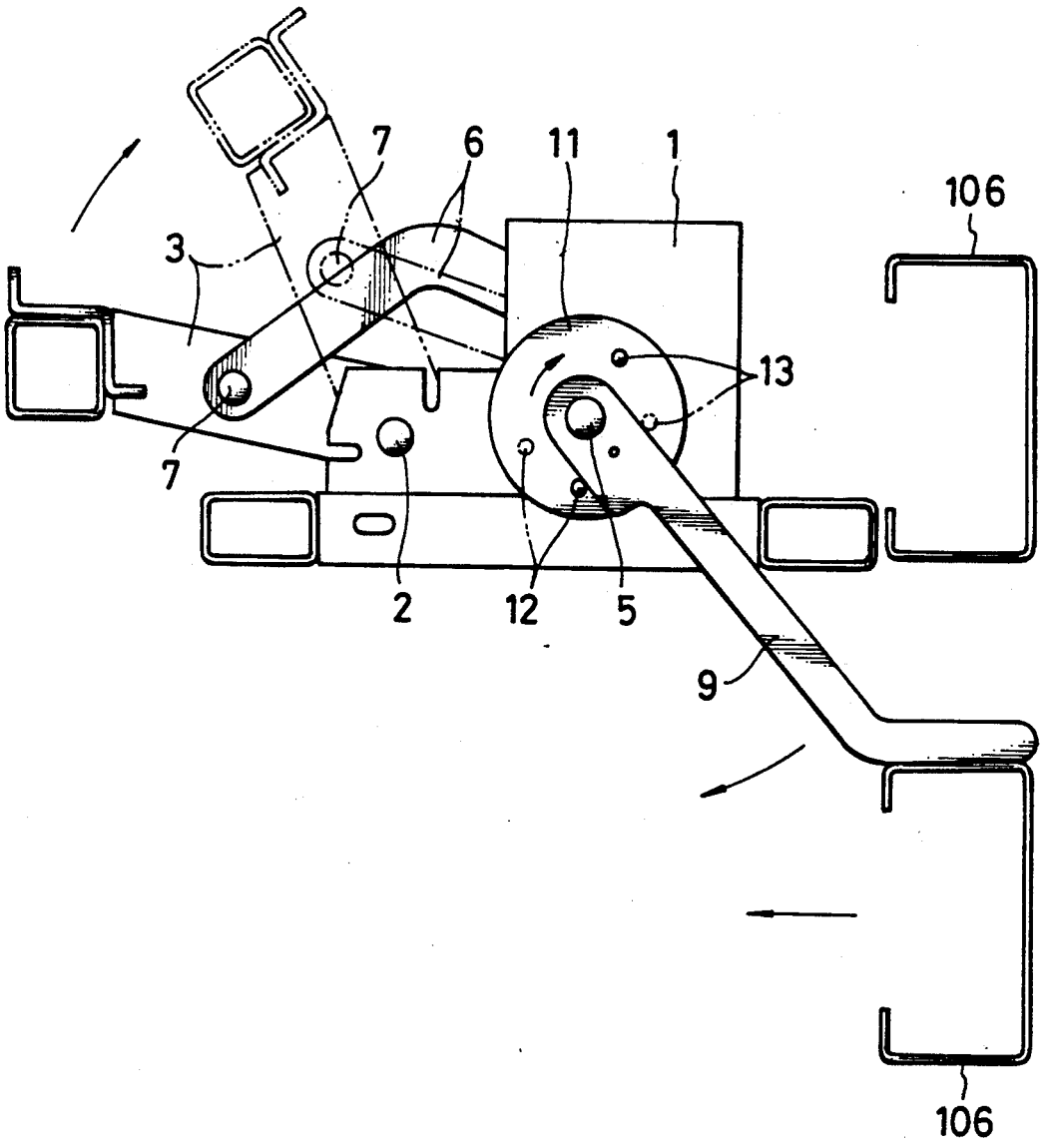
FIG. 1 is a side view of an apparatus for turning up and down a number of seats for a telescopic seating system in accordance with an embodiment of the present invention, particularly illustrating that a foot starts turning-up movement in response to forward movement of a movable platform at a certain stage.
Figure 2:
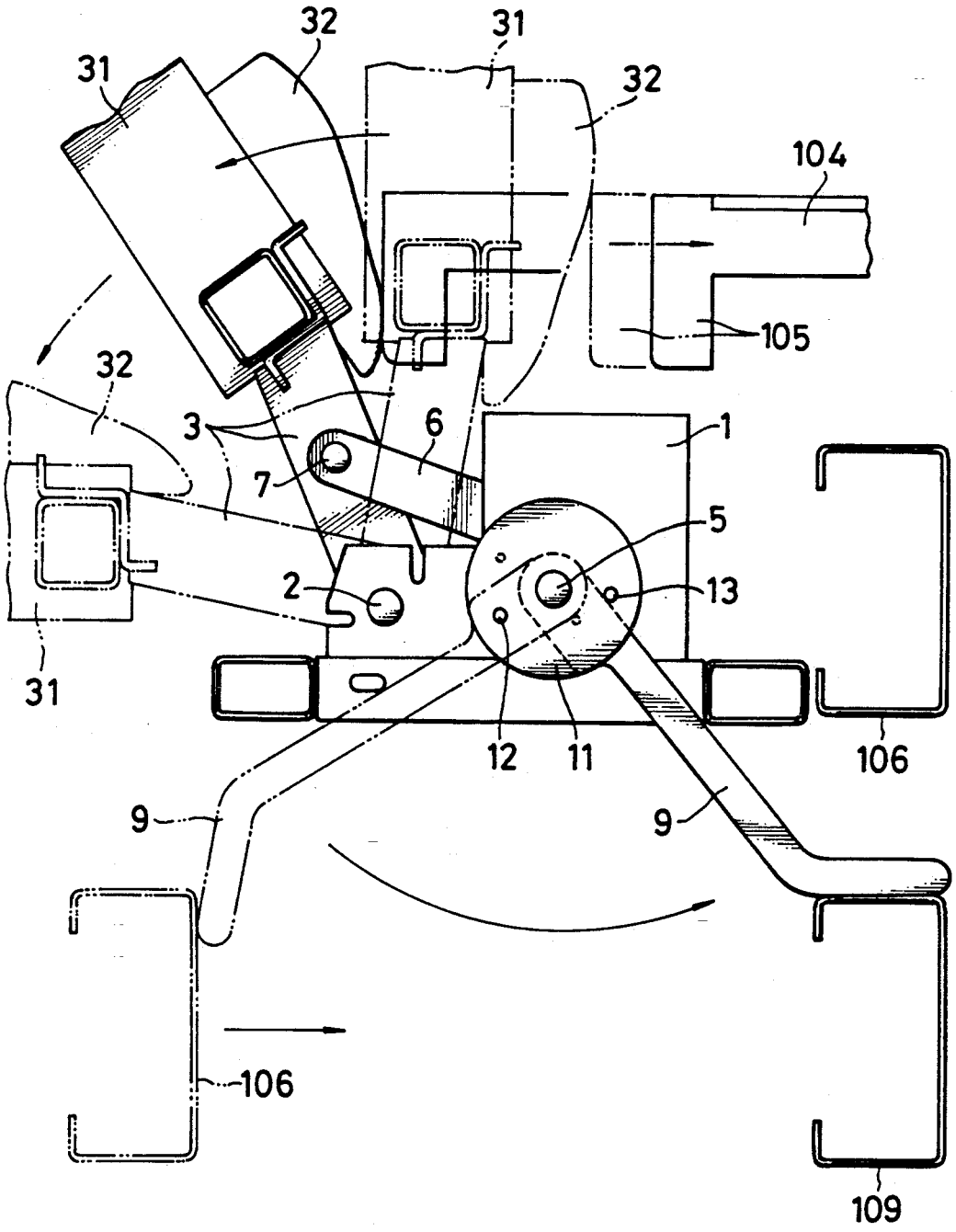
FIG. 2 is a side view of the apparatus shown in FIG. 1, particularly illustrating that the foot starts turning-down movement in response to rearward movement of the movable platform.
Figure 3:
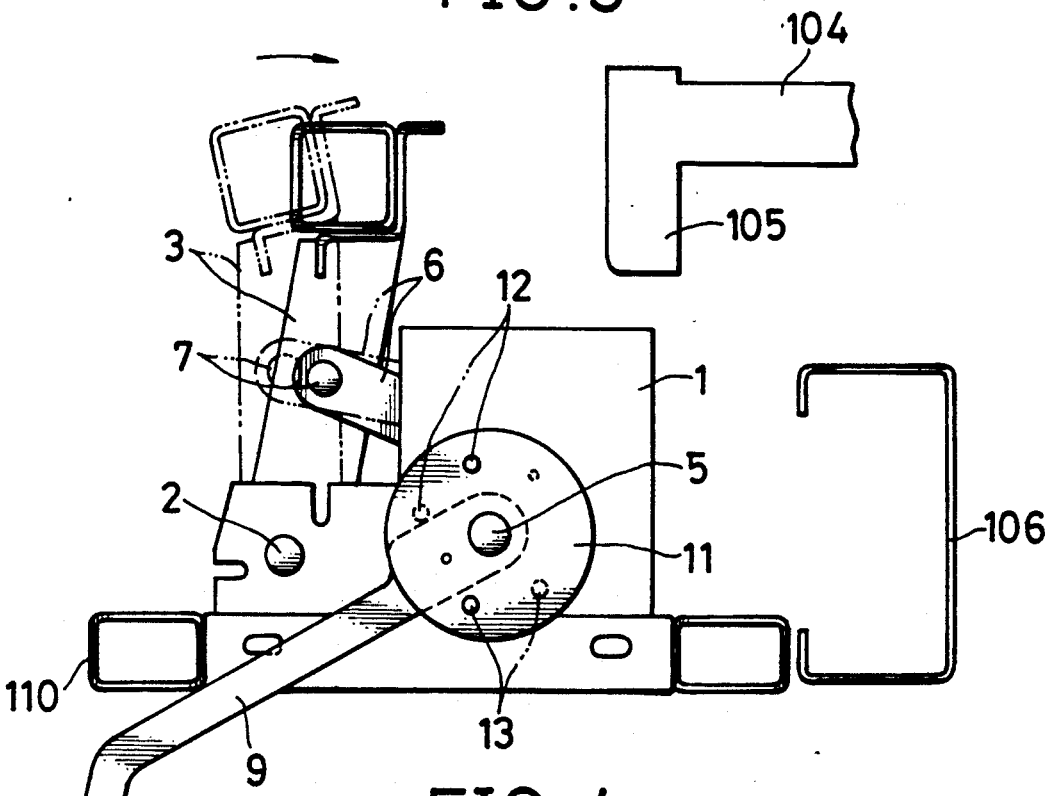
FIG. 3 is a fragmentary side view of the apparatus, particularly illustrating that the foot assumes an intermediate position (represented by two-dot chain lines) slightly before the upright standing position as well as the upright standing position (represented by solid lines) by forward turning movement of a guide arm with the aid of a resilient force derived from a plurality of coil springs.

As shown in the drawings, the apparatus 107 is basically composed of a base frame 1, a support shaft 2, a foot 3, a pair of coil spring 4 each adapted to normally turn the foot 3 in the clockwise direction as seen in FIG. 2 by the resilient force derived therefrom, a center shaft 5, a pair of link plates 6, a guide arm 9, a coil spring 10 adapted to normally turn the guide arm 9 in the clockwise direction as seen in FIG. 1 by the resilient force derived therefrom, a turn plate 11, stoppers 12 and 13 and a coil spring 14 adapted to normally turn the guide arm 9 by the resilient force derived therefrom.

Figure 6:
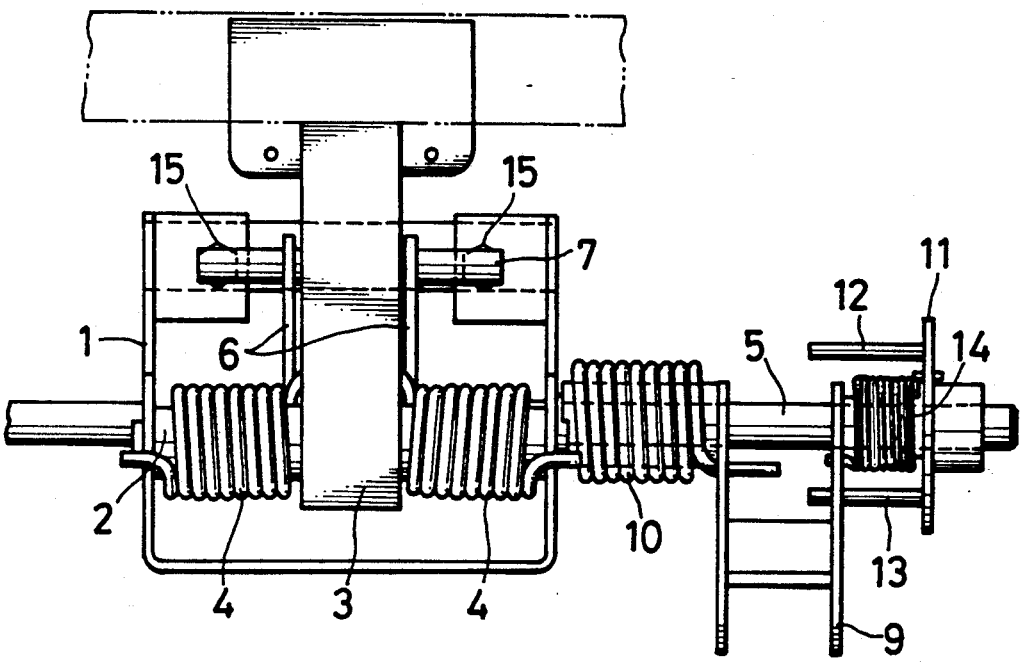
FIG. 6 is a front view of the apparatus as seen in the operative state in FIG. 4.

As is best seen in FIG. 6, the base frame 1 is designed in the substantially U-shaped cross-sectional configuration of which front side is opened to the outside.

The foot 3 is designed in the substantially square cross-sectional configuration and includes a foot member 31 and a transverse member having the substantially L-shaped cross-sectional configuration so as to allow a spectator's seat 108 to be fixedly mounted thereon (see FIG. 2). The foot 3 is turnably supported by the support shaft 2 extending through the base end part thereof in the transverse direction to turn about the support shaft 2 in the clockwise/anticlockwise direction.

The pair of coils springs 4 each having a large magnitude of resilient force are mounted on the support shaft 2 such that one end of each of the coil springs 4 is fixedly secured to the base frame 1 and the other end of the same is fixedly secured to the foot 3, whereby the foot 3 is normally biased in the raising-up direction by the resilient force derived from the coil springs 4. A front transverse shaft 7 is inserted through the foot 3 at the intermediate position of the same while extending in parallel with the support shaft 2. The foot member 31 constituting the lower end part of the spectator's seat 108 is fixedly attached to the foot 3 such that the spectator's seat 108 is turned in the raising-up/lowering direction together with the foot 3.

As is apparent from FIG. 1, the center shaft 5 is located behind the support shaft 2 while extending through the base frame 1 in the transverse direction of the spectator's seat 108. It is obvious that the center shaft 5 is inserted through the opposite base frame 1 (not shown) in the same manner.

Figure 4:
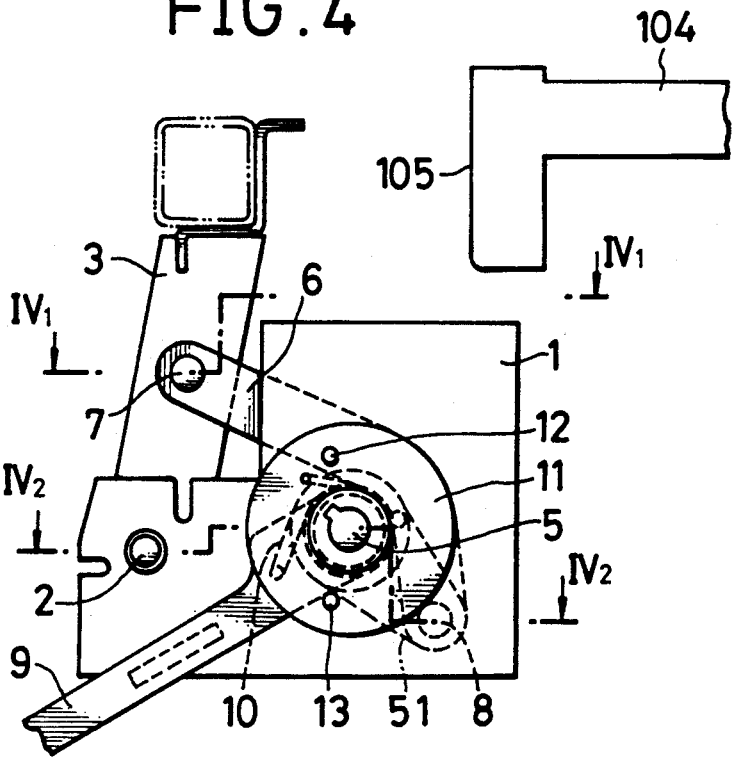
FIG. 4 is a fragmentary side view of the apparatus, particularly illustrating the operational relationship between a link plate and a pair of tongue-shaped projections when the foot is fully raised up to assume the upright standing position.
Figure 5:
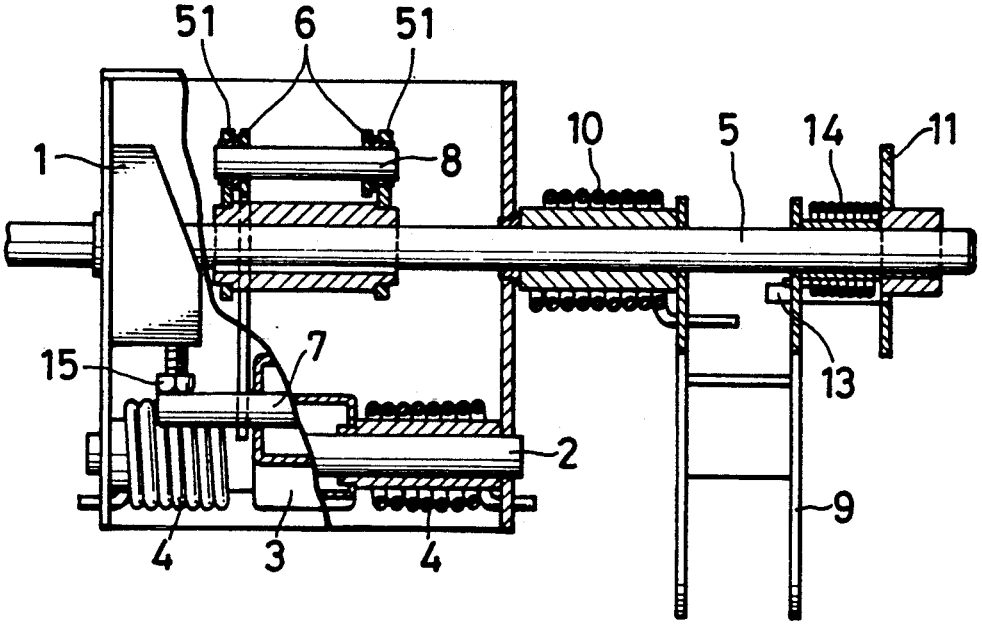
FIG. 5 is a sectional plan view of the apparatus taken along line $IV_1$—$IV_1$ and line $IV_2$—$IV_2$ in FIG. 4.

A pair of tongue-shaped projections 51 are integrated with a larger diameter portion of the center shaft 5 within the hollow space of the base frame 1 to turn about the center shaft 5 together with the same (see FIG. 4 and FIG. 5). It should be noted that the tongue-shaped projections 51 rearwardly extend in the slantwise downward direction when the foot 3 stands upright.

In addition, the front transverse shaft 7 is inserted through the pair of link plates 6 in parallel with the center shaft 5 and a rear transverse shaft 8 is inserted through the pair of tongue-shaped projections 51 in parallel with the center shaft 5, whereby the foot 3 is operatively connected to the projections 51 via the link plates 6, the fore transverse shaft 7 and the rear transverse shaft 8. With this construction, when the center shaft 5 is rotated in the clockwise direction as seen in FIG. 1 to FIG. 4, the foot 3 is raised up to assume the upright standing position. On the contrary, when the center shaft 5 is rotated in the anticlockwise direction, the foot 3 is turned downwardly (see FIG. 2 and FIG. 4).

The center shaft 5 has an extension outside of the one side wall of the base frame 1, and the base end of the guide arm 9 is rotatably mounted on the extension of the center shaft 5. The coil spring 10 adapted to normally bias the foot 3 in the raising-up direction by the resilient force derived therefrom is mounted on the extension of the center shaft 5 between the base frame 1 and the guide arm 9 such that one end of the coil spring 10 is fixedly secured to the base frame 1 and the other end of the same is fixedly secured to the guide arm 9. While any outer force is not exerted on the guide arm 9, the fore end part of the guide arm 9 is turnably displaced in the forward direction by the resilient force of the coil spring 10. On the contrary, when an outer force is exerted on the guide arm 9 from the front side, the guide arm 9 is turnably displaced in the rearward direction. The guide arm 9 is dimensioned to have a length enough to turn within the range where a transverse beam 6 of the movable platform 104 at the lower stage moves in the forward/rearward direction (see FIG. 1 and FIG. 2).

A circular rotary member 11 is fixedly mounted on the extension of the center shaft 5 at the outermost end of the same in the coaxial relationship, and a pair of stoppers 12 and 13 are projected inside of the rotary member 11 (extending toward the base frame 1) in the spaced relationship such that one of them, i.e. the stopper 12 comes in contact with the front surface of the guide arm 9 and the other one, i.e., the stopper 13 comes in the rear surface of the guide arm 9. The both stoppers 12 and 13 may be integrated with the rotary member 11 by employing a casting process. As is best seen in FIG. 5 and FIG. 6, the coil spring 14 adapted to normally bias the guide arm 9 in the clockwise direction by the resilient force derived therefrom is mounted on the extension of the center shaft 5 between the guide arm 9 and the rotary member 11.

When the foremost end of the guide arm 9 on the movable platform 104 at the present stage is turned in the rearward direction as the rear transverse beam 106 of the movable platform 104 at the lower stage (the rear member of a movable body (not shown) extending on the bottom side in a case of the movable platform 104 at the lowermost stage) moves rearwardly, i.e., when the foot 3 is turned downwardly, the stopper 12 on the rotary member 11 is brought in contact with the front surface of the guide arm 9 at the base end of the same. On the contrary, when the guide arm 9 is turned in the forward direction by the resilient force of the coil spring 10 without any outer force exerted thereon, i.e., when the foot 3 is fully raised up to assume the upright standing position, the stopper 13 on the rotary member 11 is brought in contact with the rear surface of the guide arm 9 by the resilient force of the coil spring 10. In such manner, the apparatus 107 of the present invention is constituted by the aforementioned components to provide a single assembly.

As is apparent from FIG. 7, the apparatus 107 serves as a base portion of each spectator's seat 108 adjacent to the support column 103. In practice, a plurality of spectators's seats 108 are arranged side by side relationship in the transverse direction in the spaced relationship on the movable platform 104 at each stage and each spectator's seat 108 is allocated to one of a plurality of blocks along the movable platform 104.

Next, operations of the apparatus 107 will be described below.

When the movable platform 104 are to be arranged in tiers in the extended state to put the telescopic seating system 100 having a number of apparatuses 107 of the present invention mounted thereon in practical use, an operator controls a controller (not shown) such that the movable platforms 104 are successively displaced in the forward direction one after another starting with the lowermost movable platform 104.

It should be noted that before the telescopic seating system 100 is put in practical use, all the movable platforms 104 are fully retracted in the cavity of the building without any projection outside of the inner wall surface of the building and all the spectators's seats 108 at each stage are stored in the cavity of the building while they are downwardly turned toward the surface of the movable platform 104 to assume the horizontally laid attitude. Therefore, when the telescopic seating system 100 is practically used, the operator controls the controller so as to activate a driving unit (not shown) for the telescopic seating system 100 thereby to displace the movable platforms 104 in the forward direction starting with the lowermost movable platform 104 (see FIG. 7).

At this time, first, a moving body (not shown) arranged on the bottom side of the movable platform 104 at the lowermost stage starts forward movement.

In such manner, as the movable platform 104 at each stage is displaced in the forward direction, the lowermost end of the guide arm 9 which has been forcibly placed on the transverse beam 106 of the movable platform 104 at the lower stage is released from the rearwardly turned state, whereby the guide arm 9 at the present stage is turned about the center shaft 5 in the forward direction, i.e., in the clockwise direction (see FIG. 1).

Since the stopper 12 on the rotary member 11 is brought in contact with the front surface of the guide arm 9 during the turning movement of the guide arm 9 in that way, the stopper 12 is rotated together with the guide arm 9 which has been displaced in the forward direction. This causes the center shaft 5 to be rotated in the same direction correspondingly via the rotary member 11, whereby the foot 3 operatively connected to the center shaft 5 is gradually raised up by the resilient force of the coil springs 4 until the upright standing position is reached (see FIG. 1 and FIG. 3).

Once the foot 3 has been raised up, a sum of the resilient force derived from the coil springs 4 and the resilient force derived from the coil spring 10 is continuously exerted on the foot 3. This enables the foot 3 to be easily maintained in the upright standing state without any particular necessity for an extra power to be given thereto. At this time, the fore end part of the guide arm 9 comes in contact with a square steel pipe 104 serving as a front transverse beam, resulting in further forward turning movement of the guide arm 9 being inhibited (see FIG. 3). Although the guide arm 9 has been turned to the location at this time slightly before the upright standing position is reached, it can automatically be raised up by the resilient force derived from the coil springs 4 to reach the upright standing position, without any additional force from the guide arm 9 side.

When the guide arm 9 has been turned to the position where it stands upright, the link plates 6 operatively connected to the foot 3 are free from the resilient thrust force derived from the coil springs 4 which has been exerted on the foot 3 in the circumferential direction. However, since the guide arm 9 is continuously biased in the same direction as that of raising-up of the foot 3 by the resilient force derived from the coil spring 14 mounted on the extension of the center shaft 5 between the guide arm 9 and the rotary member 11, the center shaft 5 continues to be rotated to the angular position where the stopper 13 is brought in contact with the rear surface of the guide arm 9. Thus, the foot 3 which has been held in the upright standing state is continuously pulled by the link plates 6 operatively connected to the center shaft 5.

On completion of the practical use of the telescopic seating system 100, all the movable platforms 104 should be retracted in the cavity of the building without projection outside of the wall surface of the building. To this end, the operator control the controller so as to operate the driving unit for the telescopic seating system 100 in the opposite direction, whereby the movable platforms 104 are successively displaced in the rearward direction starting with the lowermost movable platform 104. While the movable platform 104 at the lower stage (the movable body (not shown) on the bottom side in a case of the movable platform 104 at the lowermost stage) is displaced in the rearward direction, the foremost end of the guide arm 9 at the present stage is brought in contact with the rear surface of the square steel pipe 110 for the movable platform 104 at the present stage. Then, as the transverse beams 106 at the lower stage is displaced in the rearward direction, the foremost end of the guide arm 9 at the present stage is turnably displaced in the rearward direction against the resilient force of the coil spring 10 (see FIG. 2).

Then, the stopper 13 which has been brought in contact with the rear surface of the guide arm 9 is rotated in the anticlockwise direction as the guide arm 9 is turned. This causes the foot 3 which has been fully raised up to be forwardly turned to the intermediate position via the link plates 6 which are operatively connected with the rotary member 11 integrated with the center shaft 5 (see FIG. 2). Thereafter, when the foremost end of the guide arm 9 continues rearward turning movement of the guide arm 9 and is forcibly placed on the upper surface of the transverse beam 106 for the movable platform 104 at the lower stage, the movable platform 104 at the present stage starts rearward movement. As the movable platform 104 at the present stage is displaced further in the rearward direction, an abutment plate 32 fastened to the rear surface of a foot stand 31 collides against a front nose 105 at the foremost end of the movable platform 104 at the upper stage, whereby the foot 3 is increasingly turned down until it assumes the horizontally laid attitude. Consequently, a series of spectators' seats 108 arranged side by side in the transverse direction on the movable platform 104 at the present stage 104 can completely be laid down in the inoperative state on the upper surface of the movable platform 104, as represented by two-dot chain lines in FIG. 2.

The present invention has been described above as to a case where a number of spectators s seats 108 are arranged in the transverse direction in the equally spaced relationship for the telescopic seating system. Alternatively, the present invention may equally be applied to a single seat with the same advantages as those mentioned above.

Since the apparatus of the present invention is constructed and operated in the above-described manner, the following advantageous effects are obtainable.

The apparatus of the present invention is provided with a pair of coil springs within the interior of the U-shaped base frame each adapted to normally bias the foot in the raising-up direction and a coil spring mounted on an extension of the center shaft between the base frame and the guide arm to normally bias the guide arm in the direction of forward turning movement. The arrangement of the coil springs in that way generates a large magnitude of resilient force effective for raising up the foot and thereby assures that the foot can quickly and reliably stand upright without necessity for an extra power to be derived from an electric motor or the like means when the telescopic seating system is in use. Consequently, a function of the telescopic seating system can be improved substantially at an inexpensive cost of installation with a minimized quantity of consumed electricity.

In addition, since the aforementioned springs, i.e., essential components for the apparatus of the present invention are arranged in the positionally well-balanced state not only within the interior of the base beam but also outside of the base frame, a magnitude of reactive force against the resilient force derived from the aforementioned coil springs can be reduced when each spectator's seat is laid down to assume the horizontally laid position after completion of the practical use of the telescopic seating system. Therefore, a turning-down operation can be performed for all the spectators' seats with a small magnitude of extra force when the telescopic seating system is not in use.

While the present invention has been described above with respect to a single preferred embodiment, it should of course be understood that the present invention should not be limited only to this but various changes or modifications may be made without departure from the scope of the invention as defined by the appended claims.

What is claimed is:

1. An apparatus for turning up and down a number of seats for a telescopic seating system including a plurality of movable platforms to be arranged in tiers when said telescopic seating system is in use, said movable platforms being successively operatively connected to each other to extend and contract in the forward/rearward direction, said seats being arranged side by side in the transverse direction on each movable platform, said apparatus comprising:

a foot on which a single seat is fixedly mounted, said foot being turned up and down about a support shaft;

a housing in the form of a base frame having a substantially U-shaped cross-sectional configuration, said housing having said support shaft for said foot immovably inserted therethrough in the transverse direction at the fore end part thereof;

a center shaft rotatably inserted through the housing in the transverse direction at the central part of the housing, said center shaft extending in parallel with the support shaft and including an extension outside of the outer side wall of the housing;

a guide arm turnably mounted on said extension of said center shaft, the lowermost end part of said guide arm being placed on the upper surface of a rear transverse beam of a movable platform at a lower tier when the telescopic seating system is not in use and colliding against the rear surface of said rear transverse beam when the telescopic seating system is in use;

a pair of first coil springs mounted on the support shaft on both sides of the foot within the interior of the housing, one end of each of said first coil springs being fixedly secured to the support shaft so as to allow the foot to be normally biased in the turning-up direction by the resilient force derived from said first coil springs;

a second coil spring mounted on the extension of the center shaft outside of the outer side wall of the housing between the housing and the guide arm, one end of said second coil spring being fixedly secured to the center shaft and the other end of the same being fixedly secured to the guide arm so as to allow the guide arm to be normally turnably biased in the forward direction by the resilient force derived from said second coil spring;

a pair of tongue-shaped projection fixedly mounted on the center shaft within the interior of the housing while rearwardly extending from the center shaft in the slantwise downward direction, said tongue-shaped projections having a rear shaft inserted therethrough in the transverse direction at the outer ends thereof; and a link plate bridged between a front shaft inserted through the foot in the transverse direction and said rear shaft on said tongue-shaped projections so as to establish an operative connection between the foot and the guide arm via the tongue-shaped projections and the center shaft, said link plate curvedly extending between the center shaft from the front shaft on the foot down to the rear shaft on the tongue-shaped projections, whereby in response to the forward movement of the movable platform at the lower tier, the guide arm is turned in the forward direction by the resilient force derived from the second coil spring and thereby the foot is turnably raised up with the aid of the resilient force derived from the first coil springs to assume the upright standing attitude, via the center shaft, the tongue-shaped projections and the link plate.

2. The apparatus as claimed in claim 1, wherein on completion of the practical use of the telescopic seating system, the movable platform at the lower tier is displaced in the rearward direction and thereby the guide arm which has been brought in contact with the rear surface of the front transverse beam of the movable platform at the present stage collides against the rear transverse beam of the movable platform at the lower tier, whereby the rearward turning movement of the guide arm is transmitted to the foot which has stood upright, via the center shaft, the tongue-shaped projections and the link plate so to allow the foot to be turned down.

3. The apparatus as claimed in claim 2, wherein as the movable platform at the present tier is displaced in the rearward direction, the rear surface of the foot collides against the front nose of a movable platform at the upper stage, whereby the foot is fully turned down against the resilient force of the first coil springs to assume the horizontally laid position.

4. The apparatus as claimed in claim 1 further including a rotary member fixedly mounted on the extension of the center shaft outside of the guide arm, said rotary member having an opposing pair of stoppers protruded therefrom toward the guide arm in the axial direction of the center shaft, one of said stoppers located in front of the center shaft being to be brought in contact with the front surface of the guide arm so as to limit the forward turning movement of the guide arm and the other one of the same located behind the center shaft being to be brought in contact with the rear surface of the guide arm so as to allow the rearward turning movement of the guide arm to be transmitted to the foot via this stopper, the rotary member, the center shaft, the tongue-shaped projections and the link plate.

5. The apparatus as claimed in claim 1 further including a third coil spring mounted on the extension of the center shaft between the guide arm and the rotary member, one end of said third coil spring being fixedly secured to the guide arm and the other end of the same being fixedly secured to the rotary member so as to allow the guide arm to be normally turnably biased in the forward direction in addition to the second coil spring.

6. The apparatus as claimed in claim 1, wherein as the guide arm collides against the front transverse beam of the movable platform at the present tier to an intermediate position during the forward movement thereof, and thereafter as the foot continues to be turnably raised up until the upright standing position is reached, only the aid of the resilient force derived from the first coil springs is used, said intermediate position being located slightly before the upright standing position.

* * * * *